US008616376B2

(12) United States Patent
Cronin

(10) Patent No.: US 8,616,376 B2
(45) Date of Patent: Dec. 31, 2013

(54) CHILD RESISTANT CONTAINER

(75) Inventor: Edward P. Cronin, Brodhead, WI (US)

(73) Assignee: J. L. Clark, Inc., Rockford, IL (US)

( * ) Notice: Subject to any disclaimer, the term of this patent is extended or adjusted under 35 U.S.C. 154(b) by 218 days.

(21) Appl. No.: 13/087,990

(22) Filed: Apr. 15, 2011

(65) Prior Publication Data

US 2012/0260612 A1 Oct. 18, 2012

(51) Int. Cl.
*B65D 83/04* (2006.01)
*B65D 85/42* (2006.01)

(52) U.S. Cl.
USPC ..... 206/540; 206/528; 206/1.5; 206/536; 220/345.3

(58) Field of Classification Search
USPC ..... 206/540, 528, 532, 1.5, 536; 220/660, 220/522, 521, 277, 254.9, 254.1, 345.3; 229/125.125
See application file for complete search history.

(56) References Cited

U.S. PATENT DOCUMENTS

| | | | | |
|---|---|---|---|---|
| 2,353,629 | A * | 7/1944 | Apfelbaum | 206/536 |
| 3,888,350 | A * | 6/1975 | Horvath | 206/531 |
| 3,949,898 | A * | 4/1976 | Patel et al. | 220/277 |
| 4,113,098 | A * | 9/1978 | Howard | 206/540 |
| 4,364,488 | A * | 12/1982 | Anjou | 220/281 |
| 4,401,210 | A | 8/1983 | Anjou | |
| 4,591,074 | A * | 5/1986 | Kennings | 222/153.01 |
| 6,953,131 | B2 * | 10/2005 | Devine | 221/246 |
| 7,086,556 | B1 | 8/2006 | Trulove-Cranor | |
| 7,882,953 | B2 * | 2/2011 | Heller et al. | 206/499 |
| 8,091,709 | B2 * | 1/2012 | Gnepper | 206/536 |
| 2004/0055903 | A1 * | 3/2004 | Nishimura | 206/1.5 |
| 2007/0284277 | A1 * | 12/2007 | Gnepper | 206/528 |
| 2009/0266837 | A1 * | 10/2009 | Gelardi et al. | 221/154 |
| 2011/0036743 | A1 | 2/2011 | Wharton | |
| 2011/0067363 | A1 | 3/2011 | Sprada et al. | |

FOREIGN PATENT DOCUMENTS

| | | | |
|---|---|---|---|
| JP | 2003192055 | A | 7/2003 |

* cited by examiner

*Primary Examiner* — Mickey Yu
*Assistant Examiner* — Chun Cheung
(74) *Attorney, Agent, or Firm* — Reinhart Boerner Van Deuren P.C.

(57) ABSTRACT

A container of opening a container is provided. The container includes an outer shell slidably carrying a dispensing cartridge between open and closed states. A cooperating catch arrangement is operably interposed between the outer shell and the dispensing cartridge. The cooperating catch arrangement has a locked state that fixes the dispensing cartridge in the closed state relative to the outer shell and an unlocked state in which the dispensing cartridge is permitted to slide relative to the outer shell from the closed state to the open state. The cooperating catch arrangement is operable to be transitioned from the locked state to the unlocked state by resiliently reducing a width of the outer shell along a compression axis which resiliently expands a thickness of the outer shell along an expansion axis to disengage cooperating catch arrangement. A method of opening includes compressing the outer shell to disengage the cooperating catch arrangement.

16 Claims, 8 Drawing Sheets

CHILD RESISTANT CONTAINER

FIELD OF THE INVENTION

This invention generally relates to containers, and more particularly, to handheld containers for product such as candy, medicine, vitamins or other small objects.

BACKGROUND OF THE INVENTION

Containers for storing various medicines are required to be child resistant. This requirement is used to prevent children from accidentally ingesting the contents of the containers. One test that determines whether or not a container is considered child resistant is if opening the container requires a multi-step process. For instance, some child resistant containers have threaded lids that require a two-step process to remove the threaded lid from the container bottom. The two step process requires first axially pressing the threaded lid toward the container bottom and then second rotationally twisting the threaded lid relative to the container bottom. Here, the first step is axially pressing and the second step is rotationally twisting (i.e. unthreading).

One problem in designing child resistant containers is making the containers child resistant but still making the containers accessible for the elderly or disabled. It is often difficult for the disabled or elderly to grip containers strong enough to perform the two separate necessary steps.

The present invention relates to improvements in the container art generally and in particular embodiments to child resistant containers.

BRIEF SUMMARY OF THE INVENTION

Embodiments of the present invention provide new and improved containers. The new and improved containers provide a new and improved mechanism/arrangement for securing the container in a closed state and transitioning the container to an open state. In some instances, the mechanism can provide child resistance features such that the containers can be used for medicine.

In one embodiment, the container comprises an outer shell, a dispensing cartridge and a cooperating catch arrangement. The outer shell defining an opening. The dispensing cartridge defines a storage cavity and an access opening to the storage cavity. The dispensing cartridge is slidable within the outer shell between a closed state in which the access opening is closed by the outer shell prohibiting access to the storage cavity and an open state in which the access opening is open such that access to the storage cavity through the opening is permitted. The cooperating catch arrangement is operably interposed between the outer shell and the dispensing cartridge. The cooperating catch arrangement has a locked state that fixes the dispensing cartridge in the closed state relative to the outer shell and an unlocked state in which the dispensing cartridge is permitted to slide relative to the outer shell from the closed state to the open state. The cooperating catch arrangement is configured to be transitionable from the locked state to the unlocked state by resiliently reducing a width of the outer shell along a compression axis which resiliently expands a thickness of the outer shell along an expansion axis to disengage cooperating catch arrangement.

In one embodiment, the outer shell has opposed side portions. Each opposed side portion has a curved portion that bows outward and away from the other side in a relaxed state.

In one embodiment, the outer shell has opposed side portions that are formed between opposed edge portions. The width is defined between the opposed edge portions. Each side portion has a curved portion extending outward and away from the other one of the opposed sides.

In one embodiment, the outer shell has a pair of convex sidewall portions that generally define the width. The maximum width is preferably substantially at a midway point between the edges/edge portions of the outer shell. More particularly, in one embodiment, the sidewall portions extend between opposed edge portions of the outer shell. The convex sidewall portions bowing outward and away from one another such that the thickness of the outer shell at the edge portions is less than the thickness of the outer shell between and spaced from the edge portions.

In one embodiment, a stop arrangement is provided between the outer shell and the dispensing cartridge. The stop arrangement acts to limit the amount of relative sliding travel between the outer shell and the dispensing cartridge such that the dispensing cartridge is inhibited from being fully removed from the outer shell during normal operation. However, the dispensing cartridge can be removed from the outer shell under significant loading.

In one embodiment, the stop arrangement includes a channel having an abutment end and an abutment projection slidably positioned within the channel. The abutment projection axially abutting the abutment end at an end of the relative sliding travel inhibiting removal of the dispensing cartridge from the outer shell. In one embodiment, the channel does not extend entirely through the sidewall of the outer shell.

In another embodiment, the stop arrangement includes first and second abutments. The first and second abutments axially abut to limit the amount of relative sliding travel between the outer shell and the storage compartment to inhibit removal of the dispensing cartridge from the outer shell during normal operation. The cap of the container and a top/distal end of the sidewall portion of the outer shell may form a second limit that limits the amount of axial relative motion of the outer shell and the storage cartridge. These will abut when then the storage cartridge is fully inserted into the outer shell.

In a further embodiment, a container comprising an outer shell, a dispensing cartridge and a cooperating catch arrangement is provided. The dispensing cartridge is slidably carried within the outer shell between an open position in which access is permitted to a storage region of the container and a closed position in which access is prevented to the storage region by the outer shell. The cooperating catch arrangement is operably interposed between the outer shell and the dispensing cartridge. The cooperating catch arrangement has a locked state that fixes the dispensing cartridge relative to the outer shell in the closed position and an unlocked state in which the dispensing cartridge is permitted to slide relative to the outer shell from the closed position to the open position. The outer shell is resiliently compressible along a compression axis in such a mariner that at least one side portion of the outer shell resiliently flexes along an expansion axis to transition the cooperating catch arrangement from the locked state to the unlocked state.

In one embodiment, the compression axis is generally perpendicular to the expansion axis.

In one embodiment, an outer surface of the at least one side portion is generally convex when the outer shell is in a relaxed state. The convex shape directs the flexing of the at least one side portion outward along the expansion axis of the at least one side portion when the outer shell is resiliently compressed along the compression axis.

In a more particular embodiment, the compression axis is generally parallel to a width of outer shell and the expansion axis is generally parallel to a thickness of the outer shell.

Preferably, the width of the outer shell is greater than the thickness of the outer shell proximate the cooperating catch arrangement.

A method of opening a container comprising an outer shell and a dispensing cartridge carried within the outer shell is also provided. The method includes squeezing/compressing the outer shell along a compression axis causing a catch arrangement between the outer shell and the dispensing cartridge to disengage along an expansion axis that is non-parallel with the compression axis.

In one method, the method further includes axially pulling the dispensing cartridge along a sliding axis that is non-parallel to the compression and expansion axes. The step of pulling occurs after or simultaneous with, but not before, the step of squeezing/compressing.

In one method, the compression, expansion and sliding axes extend at angles of between about 80 and 100 degrees relative to one another. In a more particular embodiment, the compression, expansion and sliding axes are substantially perpendicular to one another.

In one method, the method further includes biasing the dispensing cartridge along a sliding axis that is non-parallel to the compression and expansion axes with a biasing mechanism.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
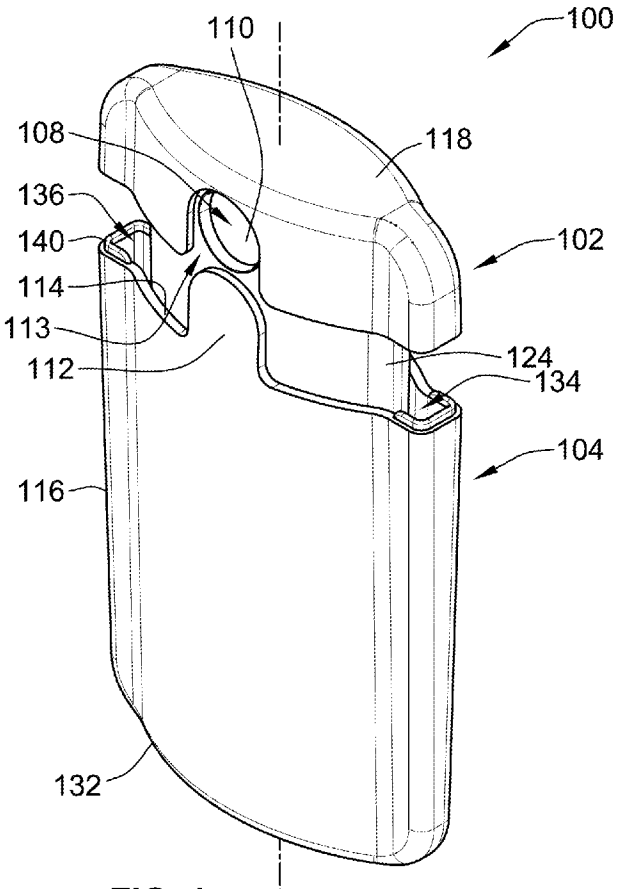
FIG. 1 is a perspective illustration of a front of an embodiment of a container in an open state.

Turning now to FIG. 1, a container 100 according to a first embodiment of the invention is illustrated. The container 100 is illustrated in an open state such that content stored therein can be accessed therefrom. The container 100 of this embodiment is constructed to be child resistant. To be child resistant according to this embodiment, the container requires two separate actions be performed to open the container 100 (i.e. transition the container 100 to the open state). In this embodiment, the container requires a user to laterally squeeze one portion of the container 100 while axially pulling on a second portion of the container 100 along an axis 106 that is different than the axis 164 along which the container is being squeezed (see FIG. 11). This operation will be more fully described below.

The container 100 generally includes a dispensing cartridge 102 that is axially slidable within an outer shell 104. The dispensing cartridge 102 and outer shell 104 axially slide relative to one another along sliding axis 106 between the open state (illustrated in FIGS. 1 and 2) and a closed state (illustrated in FIGS. 3 and 4).

With reference to FIG. 1, the container 100 is in the open state such that an access opening 108 of the dispensing cartridge is exposed to provide access to the storage cavity 110 of the dispensing cartridge 102.

Figure 3:
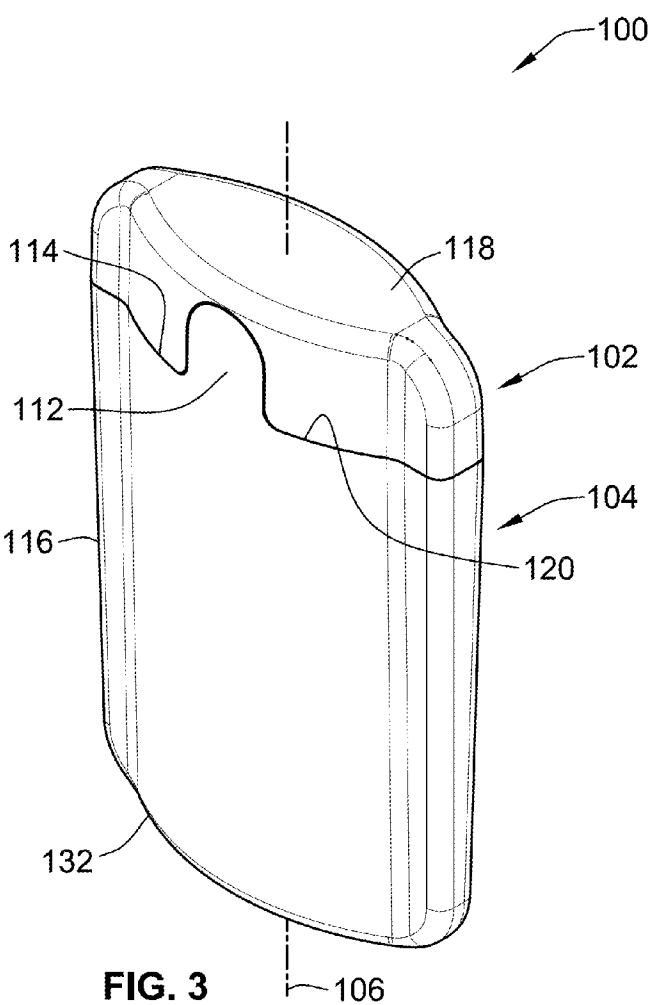
FIG. 3 is a front perspective view of the container of FIG. 1 in a closed state.
Figure 5:
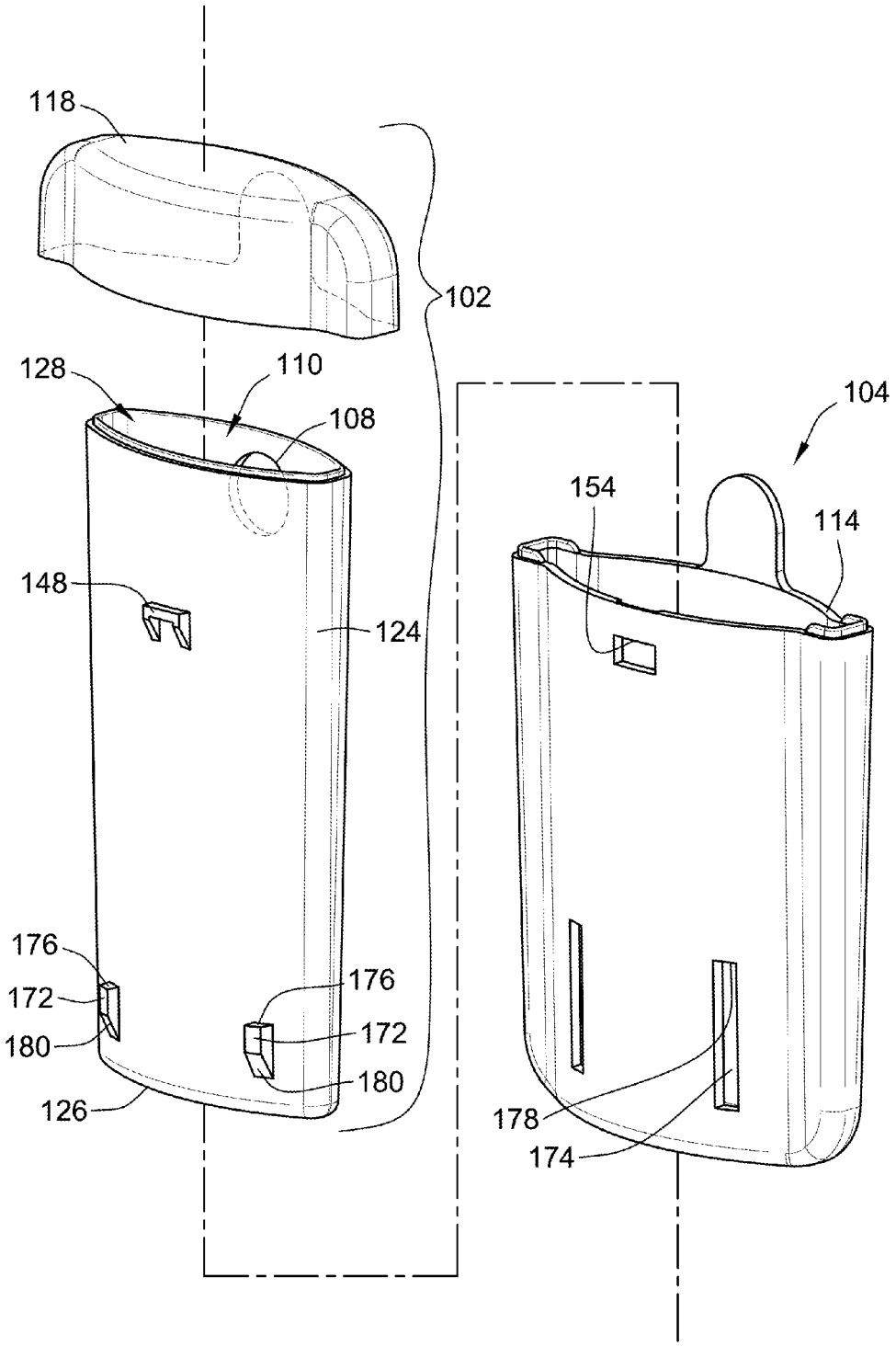
FIG. 5 is a perspective illustration of the container of FIG. 1.

With reference to FIG. 3, the outer shell 104 includes a cover portion 112 that covers access opening 108 of the dispensing cartridge 102. As such, in this arrangement illustrated in FIG. 3, the container 100 is in the closed state. More particularly, in this state, access is not permitted to the storage cavity 110. With reference to FIG. 1, the cover portion 112 forms a portion of a distal end portion 114 of a side wall portion 116 of the outer shell 104 that is axially projecting. In the illustrated embodiment, the cover portion 112 is generally hump-shaped with a curved peripheral portion/surface. The cover portion 112 mates with a corresponding cavity of the receiving location 113 of the dispensing cartridge 102. In the particular embodiment, the receiving location 113 that axially receives the cover 112 is formed in a cap portion 118 of the dispensing cartridge 102. When the cover portion 112 is received in receiving location 113, access to storage cavity 110 is prevented.

As further illustrated in FIG. 3, the outer surface of the outer shell 104 corresponds to an outer surface of the cap portion 118 such that when the distal end portion 114 of the side wall axially abuts or substantially axially abuts the cap portion 118 such that there is a substantially flush transition across the parting line 120 formed therebetween with no or a limited gap (i.e. less than 0.10 inches and preferably less than 0.05 inches).

The container 100 need not include a particular structure that provides the cover portion 112. Alternatively, the side wall portion 116 itself could act as a cover portion and distal end 114 could be substantially flat.

The dispensing cartridge 102 is generally formed from a pocket portion 124 and cap portion 118. The pocket portion 124 (also referred to as a pocket member) in the illustrated embodiment is what houses the product stored within the container. More particularly, the pocket portion 124 forms the storage portion of the dispensing cartridge 102. As such, the lower end 126 of the pocket portion 124 is closed in this embodiment. As such, when the dispensing cartridge 102 slides axially relative to the outer shell 104, in this embodiment, the product stored within the container 100 also moves relative to outer shell 104 along sliding axis 106.

The cap portion 118 is used to generally close off an open, opposite, end 128 of the pocket portion 124 formed by the distal end of the generally annular sidewall of the pocket portion 124. This open end 128 is on the opposite end of the pocket portion 124 as the closed lower end 126. This open end 128 allows for commercial filling of the pocket portion 124 with product. Once the pocket portion 124 is filled with product, the cap portion 118 can be axially attached to the pocket portion 124 proximate the open end 128. The cap portion 118 will substantially close the open end 128 of pocket portion 124. At this time, the only access to the storage cavity 110 formed by the cap portion 118 and pocket member 124 is through access opening 108. However, access opening 108 is preferably smaller in cross sectional area than open end 128 such that only a limited amount of product can be dispensed from the pocket portion 124 when the container 100 is in an open state.

With regard to the axis opening 108, the opening 108 in the illustrated embodiment provides access to the storage cavity 110 in a direction that is generally perpendicular to the axial length of the pocket portion 124 and is generally perpendicular to the access direction into the pocket portion 124 through open end 128. Access into the open end 128 is generally parallel with the sliding axis 106 while the access through access opening 108 is generally perpendicular to sliding axis 106.

The cap portion 118 may be affixed to the end portion of pocket portion 124 proximate the open end 128 such as by welding, adhesives, mechanical locking or other means. Further in other embodiments, the cap portion 118 and pocket portion 124 could be formed as a single piece of material, not two separate components together.

With reference to FIG. 1, the outer shell 104 has a generally closed bottom 132 from which side wall portion 116 extends towards distal end 114. The distal end 114 defines an opening 134 that provides access to an internal cavity 136 of the outer shell 104. The dispensing cartridge 102 extends axially out of the outer shell 104 through opening 134.

The dispensing cartridge 102 slides axially along sliding axis 106 relative to outer shell 104 between the open and closed states as noted above. The cap portion 118 will axially abut the distal end 114 when the dispensing cartridge 102 is in the closed state (see FIG. 3).

The distal end 114 of outer shell 104 includes a pair of mating flanges 140 that are axially received into the cap portion 118 in the closed state. The mating flanges 140 provide additional stability to the cap portion 118 when the cap portion 118 is in the closed state. The engagement between the mating flanges 140 and the cap portion 118 provide lateral support that assists in maintaining the position of the cap portion 118 relative to the outer shell 104 in the closed state.

The container 100 is configured to be child resistant. As such, this embodiment of the container 100 requires multiple steps or actions to transition the container from a closed state to the open state.

Figure 2:
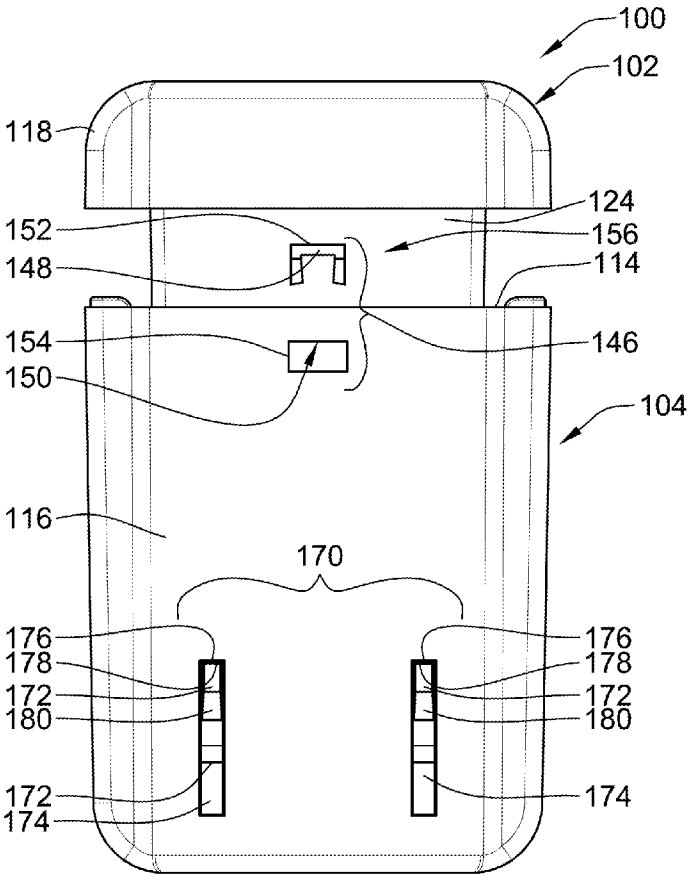
FIG. 2 is a rear profile view of the container of FIG. 1 view.
Figure 4:
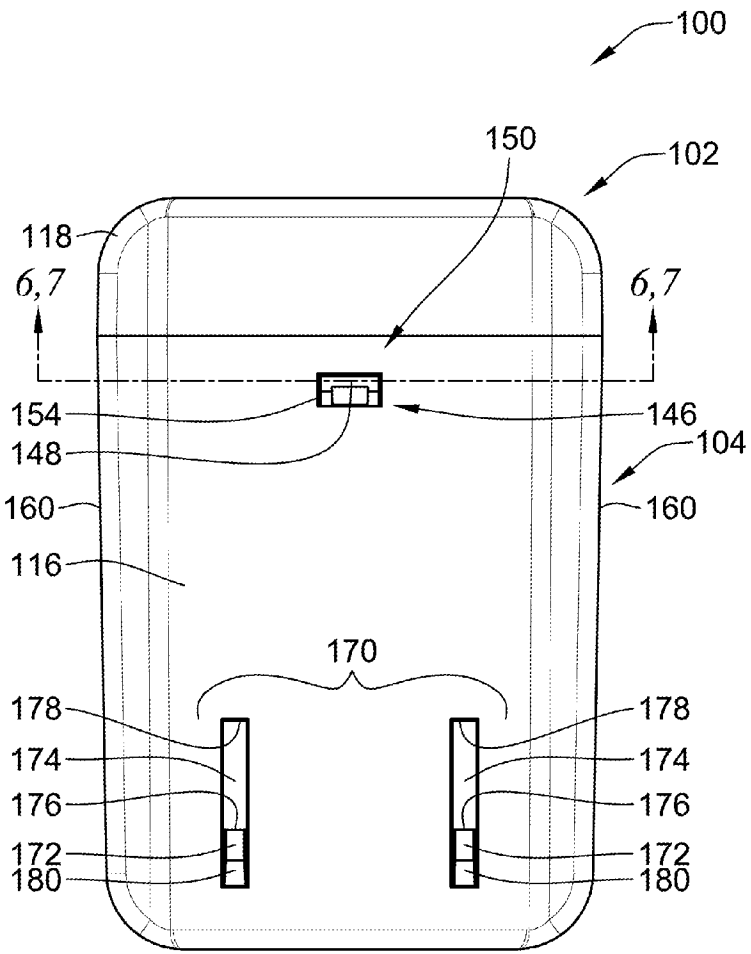
FIG. 4 is a rear profile view of the container of FIG. 1 in a closed state.

With references to FIGS. 2 and 4, the container includes a cooperating catch arrangement 146 operably interposed between the dispensing cartridge 102 and the outer shell 104 to selectively fix the dispensing cartridge 102 in the closed state. The cooperating catch arrangement 146 includes a pair of cooperating catches 148, 150 that engage to maintain the container 100 in a closed state. The cooperating catch arrangement 146 is transitional between a locked state (illustrated in FIGS. 6 and 8) and an unlocked state (illustrated in FIGS. 7 and 9).

In this embodiment, the first catch portion 148 forms part of the dispensing cartridge 102 and is moved therewith during transitions between the open and closed states. The second catch portion 150 forms part of the outer shell 104 and is moved therewith during transitions between the open and closed states. In the illustrated embodiment, the first catch portion 148 is a radially outward extending projection. The radially outward extending projection includes an abutment 152 that axially faces cap portion 118. The abutment 152 and first catch portion 148 extend radially outward from an outer surface of the pocket portion 124. The second catch portion 150 is in the form of a slot formed through side wall portion 116 of the outer shell 104. The slot forms an abutment 154 that axially faces closed bottom 132 that mates with the abutment 152 of the first catch portion 148 when the container 100 is in a locked state.

The first catch portion 152 includes a ramped portion 156 that is provided by a pair of canted surfaces. The canted surfaces extend radially outward from the outer surface of the pocket portion 124 when transitioning in a direction extending towards the cap 118. These ramped surfaces are used to allow the catch portion 148 to pass by the distal end 114 of the outer shell when the container 100 is transitioned from the open state to the closed state. More particularly, as the dispensing cartridge 102 is axially slid into the outer shell 104 the ramped surfaces of the first catch portion 148 will radially bias the side wall portion of the outer shell 104 radially outward to allow the first catch portion to pass by the distal end 114.

Once the first catch portion 148 is inserted into the second catch portion 150 such that abutments 152, 154 axially engage one another, container 100 will be in the locked state.

The side wall portions 116 of the outer shell 104 are preferably convex in cross section such that they are narrower in the thickness direction closer to the edge portions 160 and wider at the center portion substantially midway between the edge portions 160. More particularly, the outer surface of the side wall portions 116 is curved and convex. This arrangement promotes flexure of the side wall portions 116 radially outward when the compression forces 162 are applied to the edge portions 160 during the unlocking process. This curved or bowed construction allows the compression of the edge portions 160 along the compression axis 164 to create a radially outward directed force on the side wall portions 116.

With reference to FIGS. 6-9, to unlock the cooperating catch arrangement 146, the user applies a squeezing pressure to the side portions 160 (or edges) of the outer shell 104. The squeezing pressure is illustrated as arrows 162 in FIGS. 7 and 9. The squeezing pressure 162 is applied along compression axis 164. Due to the deformation of the outer shell 104 along the compression axis 164, the side wall portions 116 of the outer shell 104 flex radially outward along a second axis 166 (also referred to as an expansion axis). This expansion causes the thickness T of the outer shell to be greater than when the outer shell 104 is in a relaxed state. As the outer shell, and particularly the side wall portions thereof, flex radially outward, the first catch portion 148 will radially disengage from the second catch portion 150. More particularly, the first catch portion 148 will be positioned radially inward from the second catch portion 150 along expansion axis 166 such that there is no axial interference. As such, the dispensing cartridge 102 can be axially slid to the open state.

Figure 8:
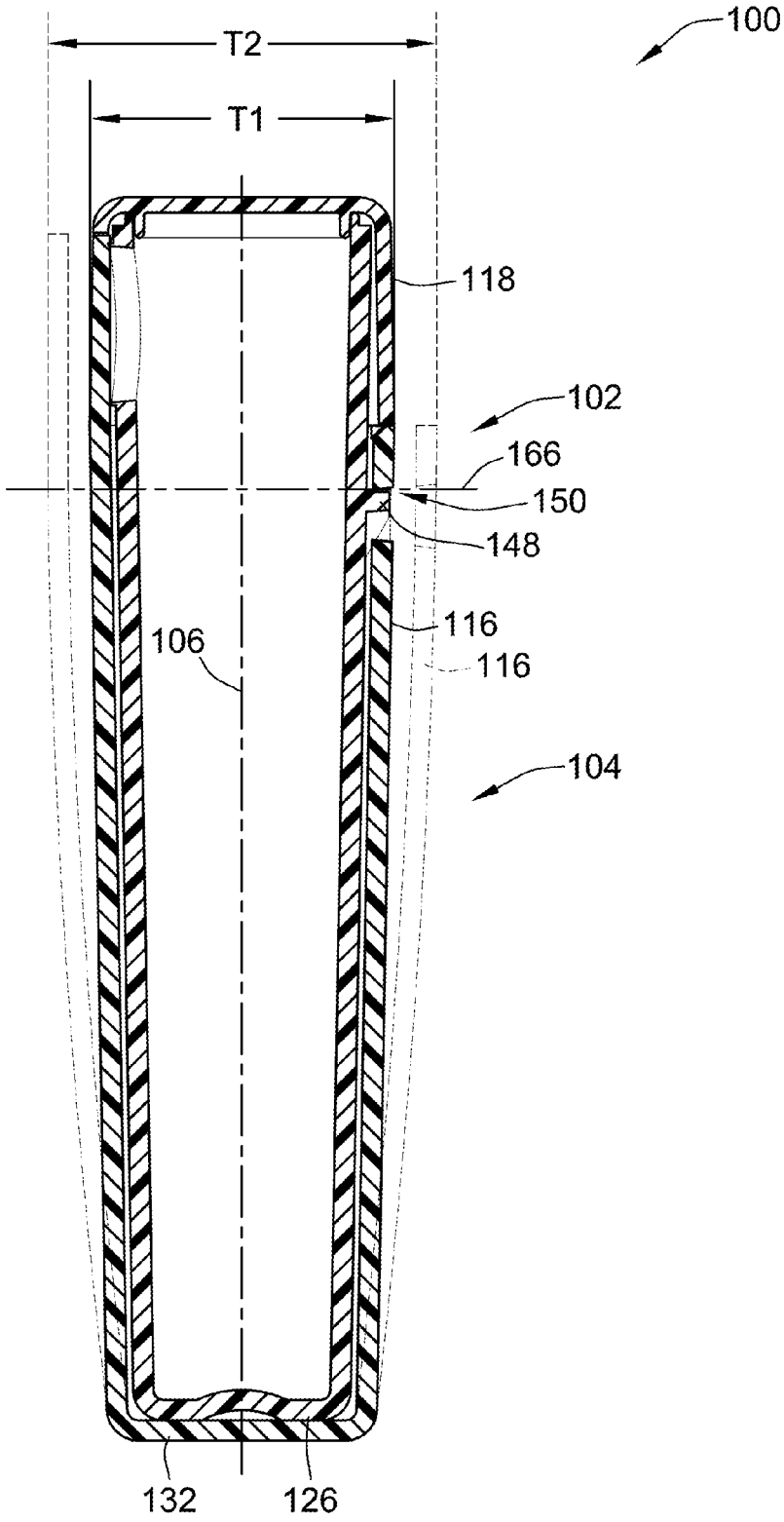
FIG. 8 is a cross-sectional illustration of the container of FIG. 1 shown in both the relaxed/locked and compressed/unlocked states.
Figure 9:
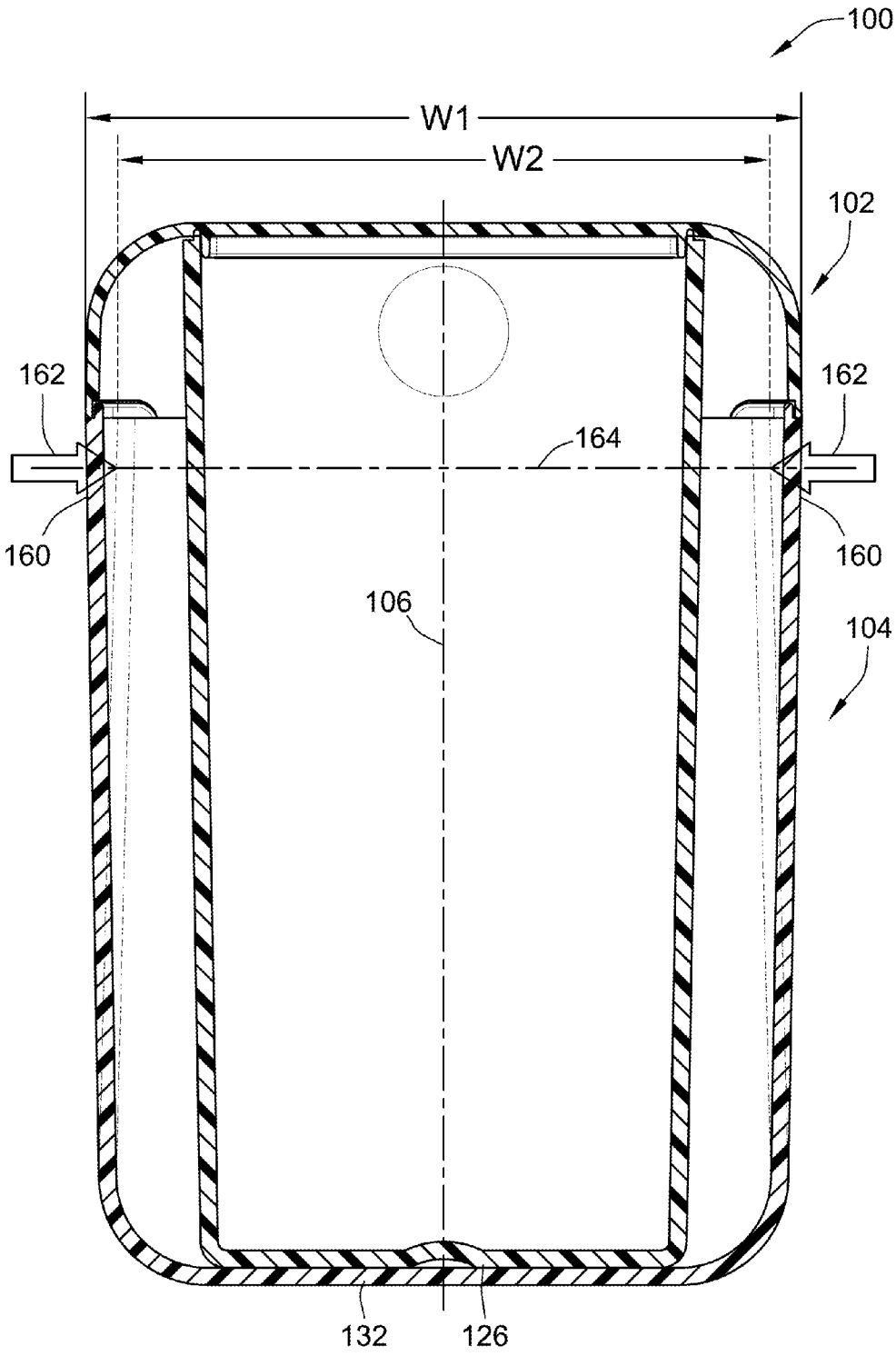
FIG. 9 is a cross-sectional illustration of the container of FIG. 1 shown in both the relaxed/locked and compressed/unlocked states.

FIGS. 8 and 9 illustrate the radially outward flexing of the outer shell 104 when the squeezing pressure 162 is applied to the edge portions 160 of the outer shell. The solid lines in FIGS. 8 and 9 illustrate the outer shell 104 in a relaxed state. The dashed lines illustrate the outer shell 104 in the deformed state. As can be seen in FIGS. 8 and 9, the width w of the outer shell 104 is reduced proximate the application location of pressures 162. This causes the side walls portions 116 to flex radially outward to make the thickness t of the outer shell 104 greater.

Again, as shown in FIG. 8, when the side wall portions 116 of the outer shell 104 are flexed radially outward due to the squeezing pressure 162, the general position of the first catch portion 148 remains the same relative to the expansion axis 166 while the second catch portion 150 is flexed radially outward such that the first and second catch portions 148, 150 no longer overlap or have a substantially similar position along axis 166. Therefore, the axial interference therebetween generally along axis 106 locking the dispensing cartridge 102 in the outer shell 104 no longer exists allowing a user to axially slide the dispensing cartridge 102 relative to the outer shell 104 to transition the container 100 to the open state. When the side wall portions 116 are flared or flexed radially outward such that the cooperating catch portions no longer interfere with one another the container is generally is in an unlocked state.

Figure 6:
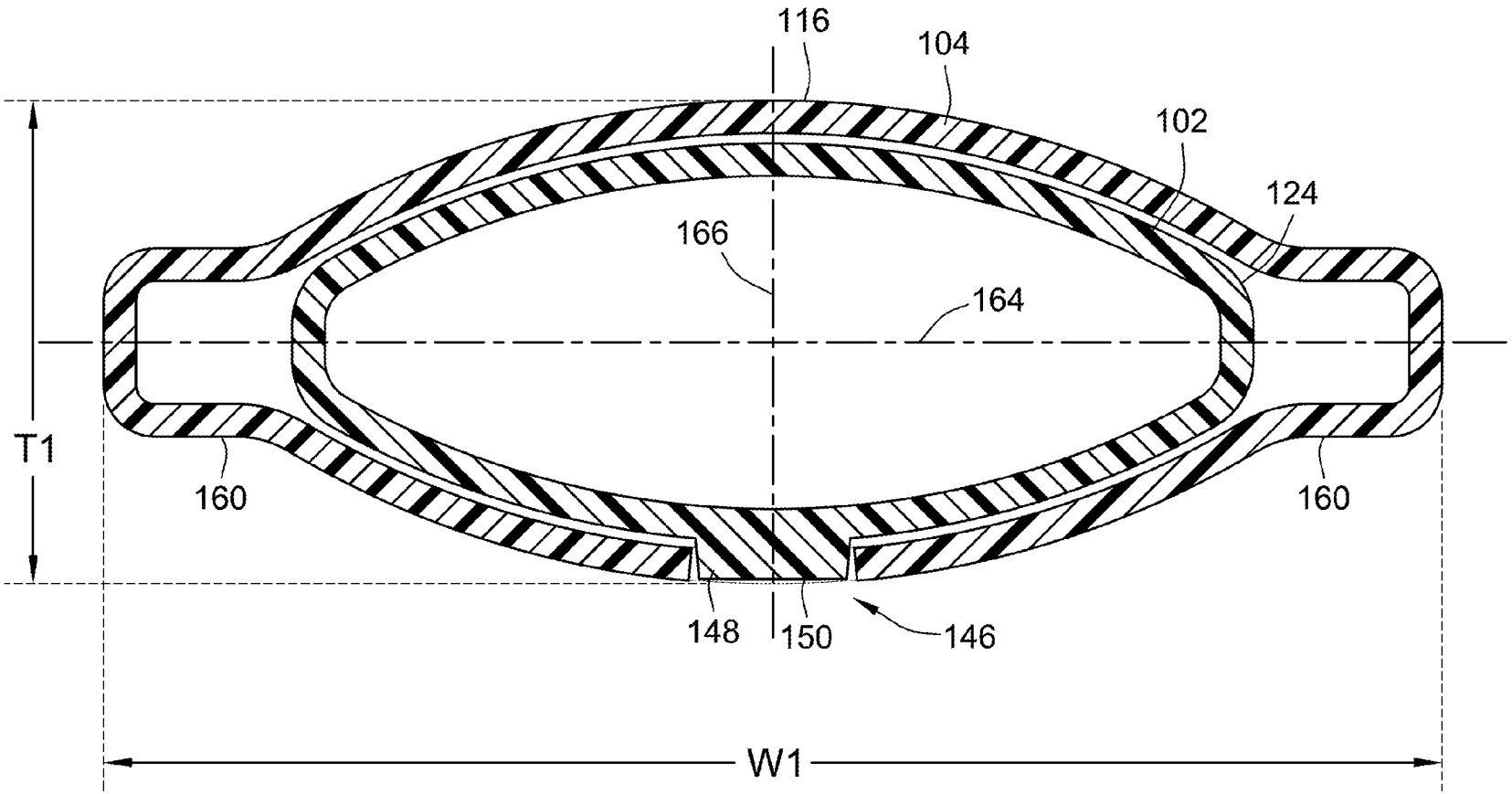
FIG. 6 is a cross-sectional illustration of the container of FIG. 1 in a relaxed state.

FIG. 6 is a cross sectional illustration of the container 100 in the locked state with the first catch portion engaging the second catch portion. At this point the outer shell 104 has not been deformed. As such, the cooperating catch arrangement is in the locked state.

Figure 7:
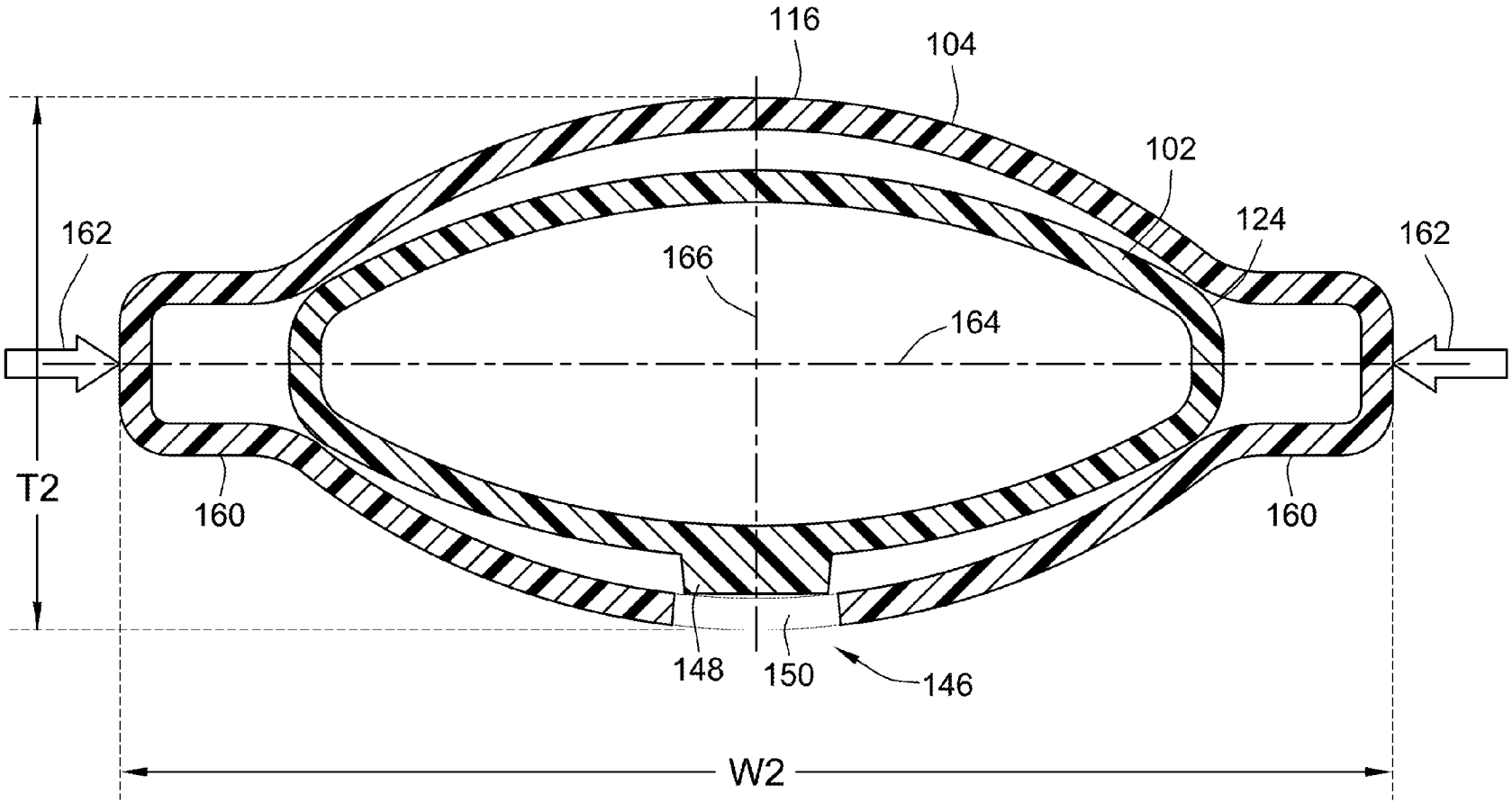
FIG. 7 is a cross-sectional illustration of the container of FIG. 1 in a compressed state.

With reference to FIG. 7 the squeezing pressure has been applied to the edge portions 160 and the width of the outer shell 104 is generally reduced along the compression axis 164.

To prevent the dispensing cartridge 102 from being undesirably fully withdrawn from the outer shell 104 when transitioning between the open and closed states, the container 100 includes a stop arrangement 170 that limits the axial travel of the dispensing cartridge 102 relative to the outer shell 104. The container 100 is preferably configured such that the stop arrangement 170 operates even when the outer shell 104 is flexed due to compressive forces applied along the compression axis 164.

The stop arrangement 170 of the illustrated embodiment includes a pair of cooperating abutments. Each pair of cooperating abutments are generally identical. The cooperating abutments of the illustrated embodiment are provided by a radially outward extending abutment projection 172 that axially slides within an axially extending slot 174. The abutment projection 172 includes an abutment surface 176 that will abut a corresponding abutment surface 178 defined by an end of slot 174 at the maximum outward displacement of the dispensing cartridge relative to the outer shell 104.

The abutment projection 172 preferably includes a tapered surface 180 that assists in initial insertion of the dispensing cartridge 102 within outer shell 104 during assembly.

In an alternative embodiment, the slots 174 need not extend entirely through the side walls portions 116 of the outer shell 104. Instead, the slots could be formed in an inner surface of the outer shell 104. Alternatively, the slots and projections could be reversed such that the slots are formed by the dispensing cartridge 102 and the projection is provided by the outer shell 104. Further yet, the stop arrangement 170 could be provided by a pair of radially extending projections rather than a projection and a slot as illustrated. Further yet, the projections and slots could be provided by radially extending shoulders or shelves formed by these facing surfaces (outer, inner, of the dispensing cartridge 102 and outer shell 104).

While the cooperating catch arrangement 146 is illustrated as a radially outward extending projection 148 and a slot formed in the outer shell 104, other arrangement could be provided, such as those discussed relating to the stop arrangement 170.

Therefore, to operate the container 100, a user will squeeze the outer shell 104 along the compression axis 164 to deform the outer shell 104. This deformation along axis 164 will cause corresponding deformation along expansion axis 166, disengaging the cooperating catch arrangement 146. Then, the user can pull on the dispensing cartridge 102 to translate the dispensing cartridge 102 relative to the outer shell 104. This will transition the dispensing cartridge 102 to the open state such that the access opening 108 is no longer covered by the cover portion 112 of the outer shell 104. At this point, the stop arrangement 170 will also limit the axial displacement of the dispensing cartridge 102 relative to the outer shell 104. This will prevent complete removal of the dispensing cartridge 102 from the outer shell 104.

While the prior embodiment illustrated a dispensing cartridge that wholly held the products contained within container 100, alternative embodiments of containers are contemplated. For instance, the dispensing cartridge 102 could merely be an inner sleeve with the primary function of providing a cap/cover and the access opening and the products stored within the outer shell 104. For instance, the dispensing cartridge 102 could strictly be used to provide the access opening 108. Therefore, when the dispensing cartridge 102 is axially translated relative to the outer shell 104, in such an embodiment, the product remains in a fixed axial position relative to the outer shell 104. This arrangement would provide for potentially a cheaper design. In such an arrangement, it would be desired that slots 174 do not extend entirely through the outer shell 104.

Figure 10:
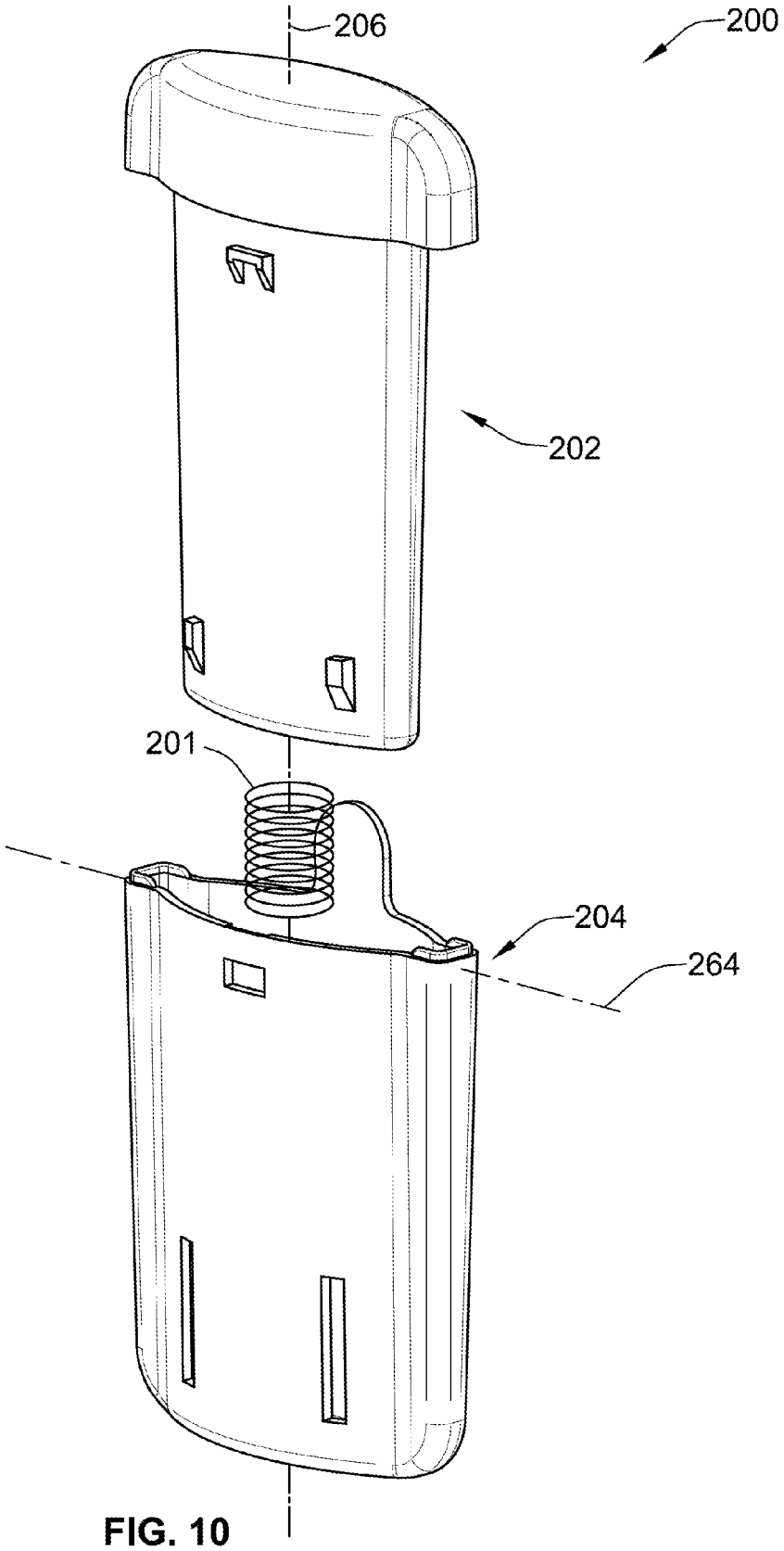
FIG. 10 is a further embodiment of a container in a partially exploded view.

Further embodiments may also be provided. For example, in FIG. 10, in a non-child resistant container, a spring member/biasing member 201 may be operably interposed between the dispensing cartridge 202 and the outer shell 204 such that once the user compresses the outer shell 204 along compression axis 264, the dispensing cartridge 202 will be automatically ejected along axis 206. Notably, this would only require one action to transition the container 200 to an open state. Thus, this would not provide the child resistant characteristics of the prior designs. However, this could be used for products that do not require storage in child resistant containers. For instance, such a container could be used for small candies, gum, etc.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container comprising:

an outer shell defining an opening;

a dispensing cartridge defining a storage cavity and an access opening to the storage cavity, the dispensing cartridge slidable within the outer shell between a closed state in which the access opening is closed by the outer shell prohibiting access to the storage cavity and an open state in which the access opening is open such that access to the storage cavity through the opening is permitted;

a cooperating catch arrangement between the outer shell and the dispensing cartridge having a locked state that fixes the dispensing cartridge in the closed state relative to the outer shell and an unlocked state in which the dispensing cartridge is permitted to slide relative to the outer shell from the closed state to the open state;

the cooperating catch arrangement transitionable from the locked state to the unlocked state by resiliently reducing a width of the outer shell along a compression axis to resiliently expand a thickness of the outer shell along an expansion axis to disengage cooperating catch arrangement; and wherein the outer shell has opposed side portions, each opposed side portion having a curved portion that bows outward and away from the other side in a relaxed state;

a stop arrangement between the outer shell and the dispensing cartridge, the stop arrangement limiting the amount of relative sliding travel between the outer shell and the dispensing cartridge such that the dispensing cartridge is inhibited from being fully removed from the outer shell during normal operation, the stop arrangement includes a channel having an abutment end and an abutment projection positioned within the channel, the abutment projection axially abutting the abutment end at an end of the relative sliding travel inhibiting removal of the dispensing cartridge from the outer shell.

2. The container of claim 1, wherein the side portions are generally convex.

3. The container of claim 2, wherein the side portions extend between opposed edge portions of the outer shell, the convex side portions bowing outward and away from one another such that the thickness of the outer shell at the edge portions is less than the thickness of the outer shell between and spaced from the edge portions.

4. The container of claim 1, wherein the opposed side portions define the thickness, the thickness being generally perpendicular to the width, a maximum thickness is formed between the curved portions of the side portions, wherein the cooperating catch arrangement includes a pair of cooperating catches including a first catch portion formed as part of the dispensing cartridge and a second catch portion formed as part of the outer shell and located proximate the maximum thickness.

5. A container comprising:

an outer shell defining an opening;

a dispensing cartridge defining a storage cavity and an access opening to the storage cavity, the dispensing cartridge slidable within the outer shell between a closed state in which the access opening is closed by the outer shell prohibiting access to the storage cavity and an open state in which the access opening is open such that access to the storage cavity through the opening is permitted;

a cooperating catch arrangement between the outer shell and the dispensing cartridge having a locked state that fixes the dispensing cartridge in the closed state relative to the outer shell and an unlocked state in which the dispensing cartridge is permitted to slide relative to the outer shell from the closed state to the open state; and the cooperating catch arrangement transitionable from the locked state to the unlocked state by resiliently reducing a width of the outer shell along a compression axis to resiliently expand a thickness of the outer shell along an expansion axis to disengage cooperating catch arrangement; and wherein the outer shell has opposed side portions that are formed between opposed edge portions, the width being defined between the opposed edges, each side portion having a curved portion extending outward and away from the other one of the opposed sides;

a stop arrangement between the outer shell and the dispensing cartridge, the stop arrangement limiting the amount of relative sliding travel between the outer shell and the dispensing cartridge such that the dispensing cartridge is inhibited from being fully removed from the outer shell during normal operation, the stop arrangement includes a channel having an abutment end and an abutment projection positioned within the channel, the abutment projection axially abutting the abutment end at an end of the relative sliding travel inhibiting removal of the dispensing cartridge from the outer shell.

6. The container of claim 5, wherein the opposed side portions define the thickness, the thickness being perpendicular to the width, a maximum thickness is formed between the curved portions of the side portions, the maximum thickness being located proximate a midpoint of the width, wherein the cooperating catch arrangement includes a pair of cooperating catches including a first catch portion formed as part of the dispensing cartridge and a second catch portion formed as part of the outer shell and located proximate the maximum thickness.

7. A container comprising:

an outer shell defining an opening;

a dispensing cartridge slidably carried within the outer shell between an open position in which access is permitted to a storage region of the container and a closed position in which access is prevented to the storage region by the outer shell;

a cooperating catch arrangement between the outer shell and the dispensing cartridge having a locked state that fixes the dispensing cartridge relative to the outer shell in the closed position and an unlocked state in which the dispensing cartridge is permitted to slide relative to the outer shell from the closed position to the open position;

the outer shell being resiliently compressible along a compression axis in such a manner that at least one side portion of the outer shell resiliently flexes along an expansion axis to transition the cooperating catch arrangement from the locked state to the unlocked state; and wherein an outer surface of the at least one side portion is convex when the outer shell is in a relaxed state, the convex shape directs the flexing of the at least one side portion outward along the expansion axis of the at least one side portion when the outer shell is resiliently compressed along the compression axis; and a stop arrangement between the outer shell and the dispensing cartridge, the stop arrangement limiting the amount of relative sliding travel between the outer shell and the dispensing cartridge such that the dispensing cartridge is inhibited from being fully removed from the outer shell during normal operation, the stop arrangement includes a channel having an abutment end and an abutment projection positioned within the channel, the abutment projection axially abutting the abutment end at an end of the relative sliding travel inhibiting removal of the dispensing cartridge from the outer shell.

8. The container of claim 7, wherein the compression axis is perpendicular to the expansion axis.

9. The container of claim 7, wherein the compression axis is parallel to a width of outer shell and the expansion axis is parallel to a thickness of the outer shell, wherein the width of the outer shell is greater than thickness of the outer shell proximate the cooperating catch arrangement.

10. The container of claim 9, wherein the outer shell has opposed edges between which the width of the outer shell is defined.

11. A method of opening a container comprising an outer shell and a dispensing cartridge carried within the outer shell comprising:

squeezing the outer shell along a compression axis to disengage a catch arrangement between the outer shell and the dispensing cartridge along an expansion axis that is non-parallel with the compression axis, wherein:

the dispensing cartridge defines a storage cavity and an access opening to the storage cavity, the dispensing cartridge slidable within the outer shell between a closed state in which the access opening is closed by the outer shell prohibiting access to the storage cavity and an open state in which the access opening is open such that access to the storage cavity through the opening is permitted;

the catch arrangement has a locked state that fixes the dispensing cartridge in the closed state relative to the outer shell and an unlocked state in which the dispensing cartridge is permitted to slide relative to the outer shell from the closed state to the open state;

the catch arrangement includes a pair of cooperating catches including a first catch portion formed as part of the dispensing cartridge and a second catch portion formed as part of the outer shell;

the catch arrangement is transitionable from the locked state to the unlocked state by resiliently reducing a width of the outer shell along a compression axis to resiliently expand a thickness of the outer shell along an expansion axis to disengage cooperating catch arrangement, the thickness being perpendicular to the width; and the outer shell has opposed side portions, each opposed side portion having a curved portion that bows outward and away from the other side in a relaxed state, the opposed side portions define the thickness, a maximum thickness is formed between the curved portions of the side portions; and the second catch portion is located proximate the maximum thickness; and the outer shell and dispensing cartridge including a stop arrangement between the outer shell and the dispensing cartridge, the stop arrangement limiting the amount of relative sliding travel between the outer shell and the dispensing cartridge such that the dispensing cartridge is inhibited from being fully removed from the outer shell during normal operation, the stop arrangement includes a channel having an abutment end and an abutment projection positioned within the channel, the abutment projection axially abutting the abutment end at an end of the relative sliding travel inhibiting removal of the dispensing cartridge from the outer shell.

12. The method of claim 11, further comprising axially pulling the dispensing cartridge along a sliding axis that is non-parallel to the compression and expansion axes.

13. The method of claim 12, wherein the compression, expansion and sliding axes extend at angles of between about 80 and 100 degrees relative to one another.

14. The method of claim 13, wherein the compression, expansion and sliding axes are perpendicular to one another.

15. The method of claim 11, further comprising biasing the dispensing cartridge along a sliding axis that is non-parallel to the compression and expansion axes with a biasing mechanism.

16. The method of claim 15, further comprising automatically translating the dispensing cartridge relative to the outer shell along the sliding axis upon disengagement of the catch arrangement due to the biasing of the biasing mechanism along the sliding axis.

* * * * *